US005136310A

United States Patent [19]

Drews

[11] Patent Number: 5,136,310

[45] Date of Patent: Aug. 4, 1992

[54] THERMAL INK JET NOZZLE TREATMENT

[75] Inventor: Reinhold E. Drews, Pittsford, N.Y.

[73] Assignee: Xerox Corporation, Stamford, Conn.

[21] Appl. No.: 589,520

[22] Filed: Sep. 28, 1990

[51] Int. Cl.[5] ..... B41J 2/14; B41J 2/05

[52] U.S. Cl. ..... 346/140 R

[58] Field of Search ..... 346/1.1, 75, 140

[56] References Cited

U.S. PATENT DOCUMENTS

| | | | |
|---|---|---|---|
| Re. 32,572 | 1/1988 | Hawkins et al. . | |
| 3,579,540 | 5/1971 | Ohlnausen et al. . | |
| 3,959,563 | 5/1976 | Vaughn | 427/314 X |
| 4,368,476 | 1/1983 | Uehara et al. . | |
| 4,612,554 | 9/1986 | Poleshuk . | |
| 4,616,408 | 10/1986 | Lloyd | 29/611 |
| 4,623,906 | 11/1986 | Chandrashekhar et al. . | |
| 4,643,948 | 2/1987 | Diaz et al. . | |
| 4,728,392 | 3/1988 | Miura et al. . | |
| 4,734,706 | 5/1988 | Lee et al. . | |
| 4,751,532 | 6/1988 | Fujimura et al. . | |
| 4,774,530 | 9/1988 | Hawkins . | |
| 4,829,324 | 5/1989 | Drake et al. . | |
| 4,851,371 | 7/1989 | Fisher et al. . | |
| 5,010,356 | 4/1991 | Albinson | 346/140 |
| 5,017,946 | 5/1991 | Masuda | 346/140 |

FOREIGN PATENT DOCUMENTS

| | | |
|---|---|---|
| 194864 | 11/1984 | Japan . |
| 178065 | 9/1985 | Japan . |

OTHER PUBLICATIONS

Shih, Peter T. K.; Antiwetting Organosilanes & Composite Films for Ink Jet Nozzles; IBM TDB, V7, N5 Sep./Oct. 1982, p. 321.

*Primary Examiner*—Joseph W. Hartary

*Attorney, Agent, or Firm*—Oliff & Berridge

[57] ABSTRACT

An ink-repellant coating is provided on the nozzle face of a thermal ink jet printhead. The nozzle face has areas made from different materials. Alkyl polysiloxanes are used to treat the nozzle face in order to control wetting characteristics so as to improve jet directionality and to prevent accumulation of debris on the face. An intermediate layer of silica formed between the nozzle face and the ink-repellant layer is provided so that the ink-repellant layer is isotropically hydrophobic.

13 Claims, 3 Drawing Sheets

THERMAL INK JET NOZZLE TREATMENT

BACKGROUND OF THE INVENTION

1. Field of the Invention

This invention relates to ink jet printing, and more particularly, to coatings for nozzle-containing faces of printheads used in ink jet printing and methods of applying the coatings.

2. Description of Related Art

In ink jet printing, a printhead is usually provided having one or more ink-filled channels communicating with an ink supply chamber at one end and having an opening at the opposite end, referred to as a nozzle. These printheads form images on a recording medium such as paper by expelling droplets of ink from the nozzles onto the recording medium. The ink forms a meniscus at each nozzle prior to being expelled in the form of a droplet. After a droplet is expelled, additional ink surges to the nozzle to reform the meniscus. An important property of a high quality printhead array is good jet directionality. This ensures that ink droplets can be placed precisely where desired on the print document. Poor jet directional accuracy leads to the generation of deformed characters and visually objectionable banding in half tone pictorial images.

A major source of ink jet misdirection is associated with improper wetting of the front face of the printhead which contains the array of nozzles. One factor which adversely affects jet directional accuracy is the interaction of ink accumulating on the front face of the printhead array with the ejected droplets. Ink may accumulate on the printhead face either from overflow during the refill surge of ink or from the spatter of small satellite droplets during the process of expelling droplets from the printhead. When the accumulating ink on the front face makes contact with ink in the channel (and in particular with the ink meniscus at the nozzle orifice) it distorts the ink meniscus resulting in an imbalance of the forces acting on the egressing droplet which in turn leads to jet misdirection. This wetting phenomenon becomes more troublesome after extensive use as the array face oxidizes or becomes covered with a dried ink film. This leads to a gradual deterioration of the image quality that the printhead is capable of generating. In order to retain good ink jet directionality, wetting of the front face desirably is suppressed. Alternatively, if wetting could be controlled in a predictable, uniform manner, jet misdirection would not be a problem. However, uniform wetting is difficult to achieve and maintain.

In thermal ink jet printing, a thermal energy generator, usually a resistor, is located in the channels near the nozzles a predetermined distance therefrom. The resistors are individually addressed with a current pulse to momentarily vaporize the ink and form a bubble which expels an ink droplet. As the bubble grows, the ink bulges from the nozzle and is contained by the surface tension of the ink as a meniscus. The rapidly expanding vapor bubble pushes the column of ink filling the channel towards the nozzle. At the end of the current pulse the heater rapidly cools and the vapor bubble begins to collapse. However, because of inertia, most of the column of ink that received an impulse from the exploding bubble continues its forward motion and is ejected from the nozzle as an ink drop. As the bubble begins to collapse, the ink still in the channel between the nozzle and bubble starts to move towards the collapsing bubble, causing a volumetric contraction of the ink at the nozzle and resulting in the separation of the bulging ink as a droplet. The acceleration of the ink out of the nozzle while the bubble is growing provides the momentum and velocity of the droplet in a substantially straight line direction towards a recording medium, such as paper. The collection of ink on the nozzle-containing face of thermal ink-jet printheads causes all of the problems discussed above.

Ink jet printheads include an array of nozzles and may be formed out of silicon wafers using orientation dependent etching (ODE) techniques. The use of silicon wafers is advantageous because ODE techniques can form structures, such as nozzles, on silicon wafers in a highly precise manner. Moreover, these structures can be fabricated efficiently at low cost. The resulting nozzles are generally triangular in cross-section. Thermal ink jet printheads made by using the above-mentioned ODE techniques are typically comprised of a channel plate which contains a plurality of nozzle-defining channels located on a lower surface thereof bonded to a heater plate having a plurality of resistive heater elements formed on an upper surface thereof and arranged so that a heater element is located in each channel. The upper surface of the heater plate typically includes an insulative layer which is patterned to form recesses exposing the individual heating elements. This insulative layer is referred to as a "pit layer" and is sandwiched between the channel plate and heater plate so that the nozzle-containing front face has three layers: the channel plate, the pit layer and the heater plate. For examples of printheads employing this construction, see U.S. Pat. Nos. 4,774,530 to Hawkins and 4,829,324 to Drake et al, the disclosures of which are herein incorporated by reference.

These heater and channel plates are typically formed from silicon. The pit layer sandwiched between the heater and channel plates, however, is formed from a polymer, typically polyimide. Since the front face of the printhead is made from different materials, a coating material , such as a water-repellent material, will not adhere equally well to these different materials, resulting in a coating which is not uniformly ink-repellent. Thus, it is difficult to provide a surface coating which is uniformly ink-repellent in ink jet printheads formed from multiple layers.

Additionally, these printers typically use an ink which contains a glycol and water. Glycols and other similar materials are referred to as humectants, which are substances which promote the retention of moisture. For a coating material to be effective for any length of time, it must both repel and be resistant to glycol-containing inks.

Further, it is difficult to apply a coating to the face of an ink jet nozzle. While it is desirable to suppress the wetting property of the nozzle jet surface, it is undesirable to allow any coating material to enter the channels of the nozzle. A key requirement for good directionality is that the interior channel walls not be coated. If the walls of the channels become coated with ink-repellent material, proper refill of the channel is inhibited. Refill of each channel depends on surface tension and must be completed in time for subsequent volleys of drops to be fired. If the refill process is not complete by the time the next drop is fired, the meniscus may not be flush with the outer edge of the nozzle orifice, resulting in misdirection. Further, an incompletely filled channel causes drop size variability which also leads to print quality degradation.

Uehara et al U.S. Pat. No. 4,368,476 discloses ink jet recording heads which are treated with a compound represented as $RSiX_3$, wherein R is a fluorine containing group and X is halogen, hydroxyl or a hydrolyzable group. The ink jet recording head may contain a number of differing materials, and accordingly, it is difficult to provide uniform coating.

Diaz et al U.S. Pat. No. 4,643,948 discloses coatings for ink jet nozzles. An ink jet nozzle plate is coated with a film which comprises two ingredients. One ingredient is a partially fluorinated alkyl silane and the other ingredient is a perfluorinated alkane. The silane compound and the alkane compound are preferably deposited on the nozzle surface by direct exposure of the surfaces to radio frequency glow discharge. The Diaz et al reference does not disclose application of an ink-repellent material to a printhead made from silicon or that is compatible with glycol-containing based inks. Additionally, Diaz et al does not address any of the problems involved with applying a liquid-repellent material to a nozzle-containing face made from multiple materials.

Le et al U.S. Pat. No. 4,734,706 discloses a printhead for an ink jet printer having a protective membrane formed over the ink orifice. A viscoelastic and ink-immiscible fluid is used to form the membrane over the ink orifice. The membrane may comprise a silicone oil such as polydimethylsilicone polymers. The membrane lies in a plane perpendicular to the direction of emission of ink drops, and provides a barrier between the ink orifice and the external atmosphere, thus inhibiting evaporation of ink and the entry of contaminants. Wetting of the exterior surface of the ink jet head by the flow of ink through the ink orifice is also inhibited.

Miura et al U.S. Pat. No. 4,728,392 discloses an ink jet printer of the electro-pneumatic type wherein an inner surface of a front nozzle plate and an end face of a rear nozzle member may be coated with a thin layer of an ink-repellent material. The ink-repellent material may be an ethylene tetrafluoride resin such as Teflon, a trademark of du Pont, or a fluoride-containing polymer. Miura et al also discloses blowing air through a nozzle while an ink-repellent material is applied thereto to prevent clogging of the nozzle. The nozzle-containing face of Miura et al is made from one material.

Fujimura et al U.S. Pat. No. 4,751,532 discloses a thermal electrostatic ink jet recording head wherein thermal energy and an electrostatic field are applied to ink held between two plate members to cause the ink to be jetted out from an orifice defined by the plate members. Critical surface tensions must be satisfied to maintain a desired shape of the meniscus to provide good printing quality. Surfaces of the plate members are treated to provide different surface tensions. The surfaces may be treated with a silicone-type or fluorocarbon-type resin. Fujimura et al requires that an area surrounding the nozzle remains adherent to liquid and also does not address the problems which arise when a nozzle face is made from different materials.

Chandrashekhar et al U.S. Pat. No. 4,623,906 discloses a surface coating for ink jet nozzles. The coating includes a first layer of silicon nitride, an intermediate layer graded in composition, and a top-most layer of aluminum nitride. Chandrashekhar et al provide this structure to aid in adhering the low wettable, aluminum nitride layer to the nozzle-containing face which is made from glass or silicon. Chandrashekhar et al do not address the problem of coating a nozzle-face made from multiple, different materials or disclose any of the materials usable in the present invention for coating silicon.

OBJECTS AND SUMMARY OF THE INVENTION

It is an object of the invention to provide an ink-repellent layer on the nozzle-containing face of an ink jet printhead to prevent the accumulation of ink and other material on the nozzle-containing face and thus maintain good ink jet directionality.

It is another object of the invention to provide an ink-repellent coating for a printhead which renders the nozzle-containing face of the printhead uniformly ink-repellent even when the nozzle-containing face is made from a plurality of different materials.

It is another object of the invention to provide an ink-repellent layer on the nozzle-containing face of an ink jet printhead which is compatible with glycol-containing inks, is stable over long periods of time and is free from unwanted material build-up during deposition on the nozzle face.

It is a further object of the invention to provide a method for applying an ink-repellent coating to the face of a printhead which does not coat the interior surfaces of the nozzle-forming channels in the printhead so that a meniscus can form properly at each nozzle.

It has been discovered that for achieving consistently reproducible directional accuracy, it is highly desirable that wetting of the front face of an ink jet nozzle is suppressed. If uniform wetting could be produced in a predictable way, good directionality might be possible without the use of a hydrophobic agent. The key is uniformity. The wetting pattern should not disturb the translational symmetry of the forces acting on each jet. Since this is extremely difficult to control, it has been discovered that the best way to ensure good results is to suppress front face wetting entirely. This approach also avoids the problem of ink leaking out onto the printer mechanism from excessive front face wetting.

To achieve the foregoing and other objects, and to overcome the shortcomings discussed above, ink-repellent materials and methods of applying ink-repellent materials to the nozzle-containing face of an ink jet printhead are disclosed. the ink-repellant materials usable in the invention are alkyl polysiloxanes. The front face of the printhead is first be coated with a material such as silica as an intermediate layer which will render the front face isotropically hydrophobic when the ink-repellent coating is applied. A method for applying the ink-repellent coatings is also provided wherein gas is blown through the channels during the coating process. The method ensures that only the front face is coated with ink-repellent material and not the channel walls.

BRIEF DESCRIPTION OF THE DRAWINGS

The invention will be described in detail with reference to the following drawings in which like reference numerals refer to like elements and wherein.

DESCRIPTION OF THE PREFERRED EMBODIMENTS

The present invention provides ink-repellent coatings for ink jet nozzles as well as methods of forming the coated nozzles. In particular, a coating is provided comprising a material which substantially repels ink which is jetted through the nozzles. In other words, a material is provided which will suppress the wettability of the front face of a printhead which contains a plurality of nozzles.

Figure 1A:
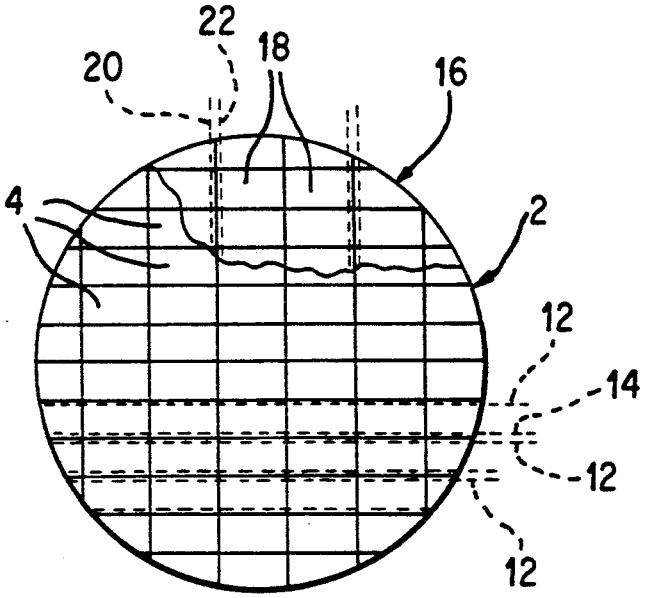
FIG. 1A is a schematic plan view of aligned and mated silicon wafers, the partially removed top wafer containing a plurality of etched channel plates.

The invention will be described in detail with reference to the Figures. In FIG. 1A, a two-side polished, (100) silicon wafer 2 is used to produce the plurality of channel plates 4 for mating with a heating element (actuator) plate 18, a plurality of which are formed from a second wafer 16, to form a subunit 24 of a large array or pagewidth printhead. After wafer 2 is chemically cleaned, a silicon nitride layer (not shown) is deposited on both sides. Using conventional photolithography, vias for elongated slots 10 for each channel plate 4 are printed on each side of each channel plate 4. The silicon nitride is plasma etched off of the patterned vias representing the elongated slots. A potassium hydroxide (KOH) anisotropic etch is used to etch the elongated slots 10. In this case, the (111) planes of the (100) wafer make an angle of 54.7° with the surface of the wafer. These vias are sized so that they are entirely etched through the 20 mil thick wafer 2.

Next, the opposite side of wafer 2 is photolithographically patterned, using the slots 10 as a reference to form the plurality of sets of channel grooves 6, and one or more fill holes 8. This fabricating process requires that parallel milling or dicing cuts be made later which are perpendicular to the channel grooves 6. One dicing cut is made at the end of the channel grooves 6 opposite the ends adjacent the fill hole 8, as indicated by dashed line 12. Another one is made on the opposite side of the fill holes, as indicated by dashed line 14, in order to obtain a channel plate with sloping sides 9 produced by the anisotropic etching. The fill holes 8 may be placed into communication with the ink channels 6 by isotropic etching as taught in U.S. Pat. No. Re. 32,572 or by etching flow paths in a thick film layer on the heating element plate 18 as taught by the above-incorporated Hawkins U.S. Pat. No. 4,774,530.

Figure 1B:
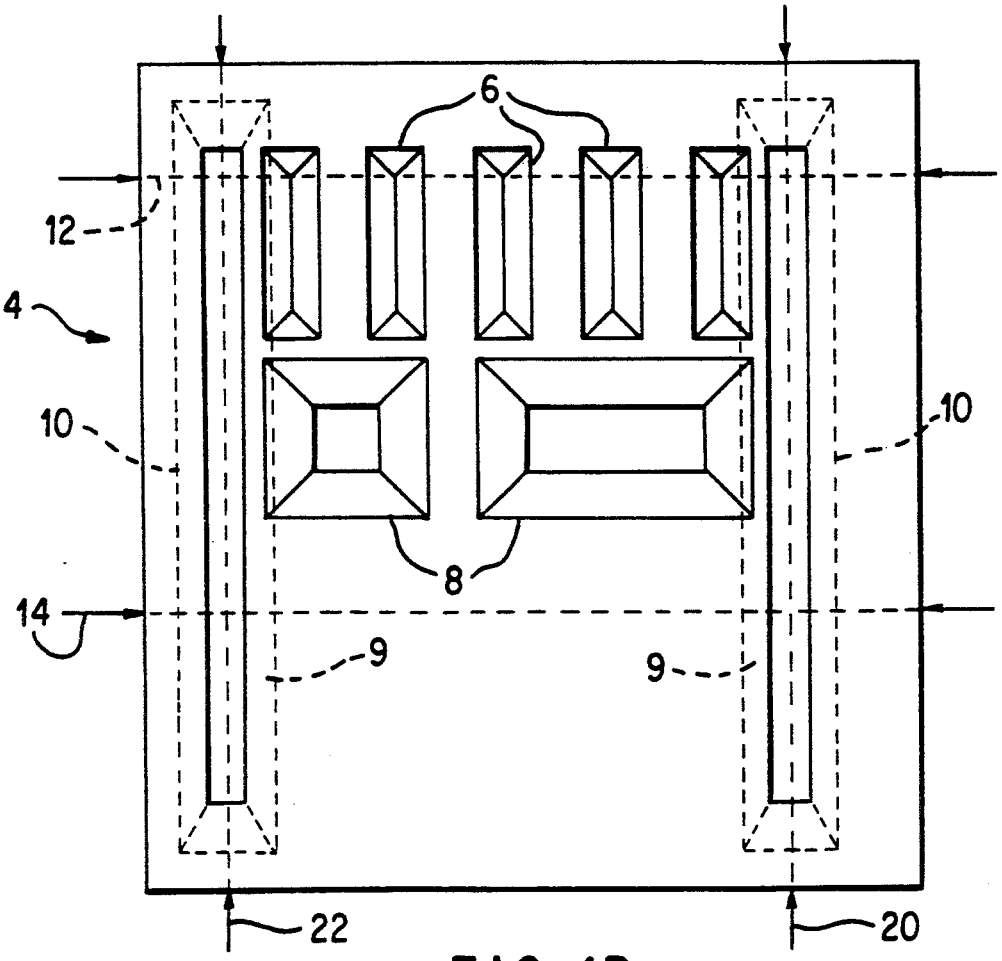
FIG. 1B is one of the channel plates 4 shown enlarged, with some of the horizontal dicing lines shown in dashed line and the exposed bottom wafer containing a plurality of sets of heating elements with some of the pairs of parallel vertical dicing lines shown in dashed line.
Figure 3:
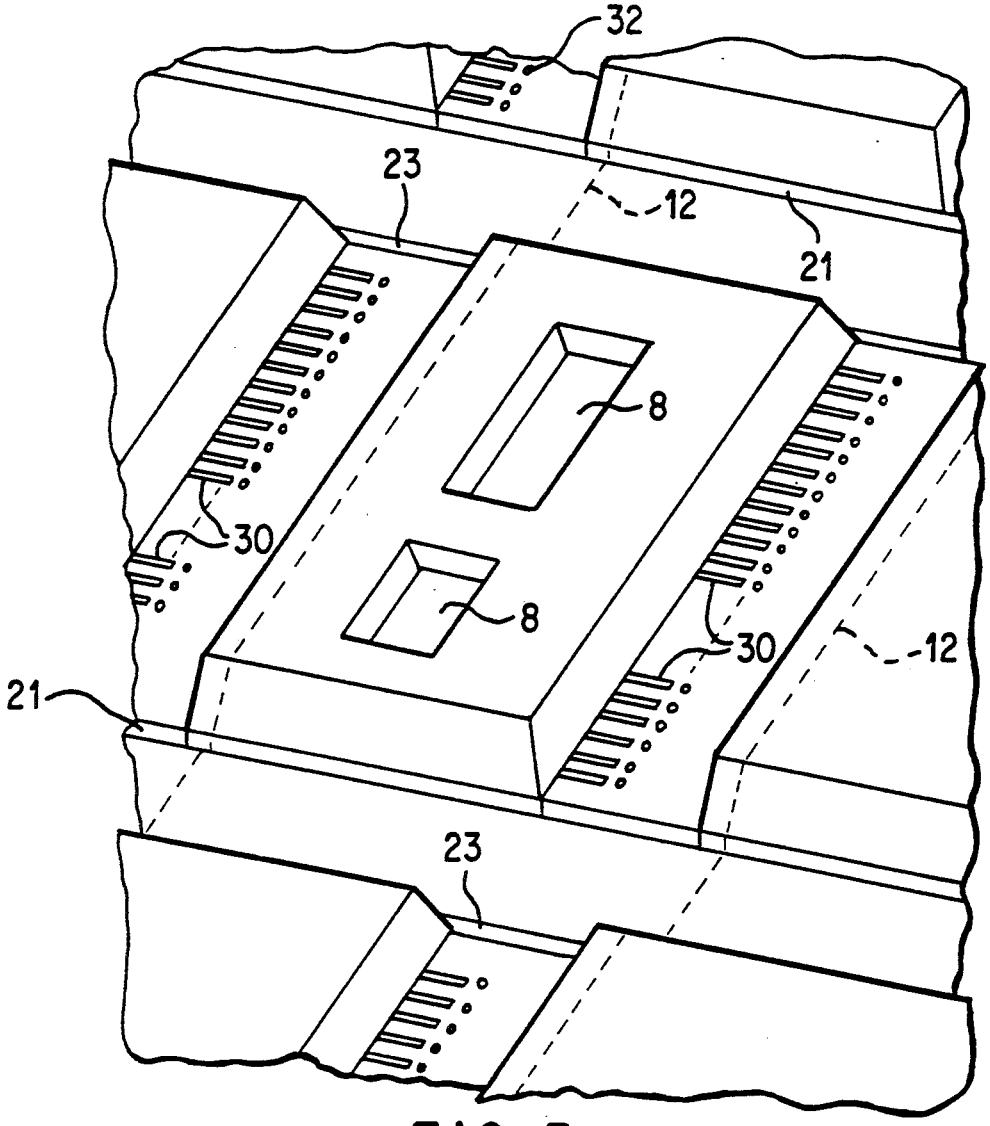
FIG. 3 is an enlarged isometric view of the channel wafer bonded to the heating element wafer after the unwanted channel wafer material has been removed to expose the electrode terminals and FIG. 4 is a cross section of the printhead in FIG. 2 with an ink-repellent coating on the front face of said printhead.

A plurality of sets of heating elements (not shown) with addressing electrodes 30 (see FIG. 3) are formed on one surface of substrate 16, which may also be a silicon wafer by means well known in the art. This substrate or wafer 16 is aligned and mated to the etched channel wafer 2 as taught by U.S. Pat. No. Re. 32,572, and then dicing cuts are made to remove unwanted silicon wafer material from wafer 2 in order to expose the heating element electrode terminals 32 on wafer 16. Referring to FIG. 3, an isometric view of the mated wafers is shown before the final dicing operation is conducted along dicing line 12 to produce the printhead subunits 24 and concurrently open the nozzles 6. Each portion or heating element plate 18 of wafer 16 contains a set of heating elements and addressing electrodes 30, and has a remaining channel plate portion 4 bonded thereto. Dicing lines 20, 22 shown in dashed lines in FIG. 1A and 1B shown as kerfs 21, 23 in FIG. 3 delineate how the wafer 16 is cut into fully operational printhead subunits 24 when dicing along cutting line 12 is accomplished. The above-described method of fabricating a plurality of printhead subunits from a pair of bonded wafers is disclosed in Fisher et al U.S. Pat. No. 4,851,371, the disclosure of which is herein incorporated by reference.

Figure 2:
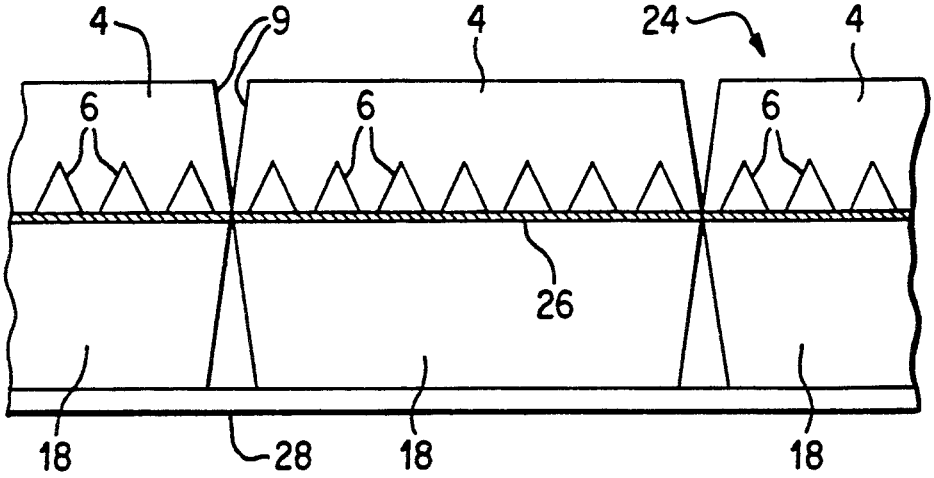
FIG. 2 is a front view of a plurality of printheads butted against one another on a substrate to form an extended array of printheads.

As illustrated in FIG. 2, each resulting printhead 24 will include a nozzle-containing face comprised of three layers: a first layer containing channel plate 4, a second layer containing heater plate 18 and an intermediate layer containing polyimide pit layer 26. Pit layer 26 is required to protect the addressing electrodes 30 and other circuitry which may be contained on the upper surface of heater plate 18 from exposure to ink. Pit layer 26 may comprise other photolithographically patternable material besides polyimide such as, for example, Riston ®, Vacrel ® or Probimer ®. Part of layer 26 is photolithographically patterned and etched to remove it from each heating element so that a recess or pit is formed having walls that expose each heating element. The recess walls formed around each heating element inhibit lateral movement of each bubble generated by the pulsed heating element, and thus promote bubble growth in a direction normal thereto. For a further understanding of the functioning of pit layer 26, see the above-incorporated U.S. Pat. No. 4,774,530.

Figure 4:
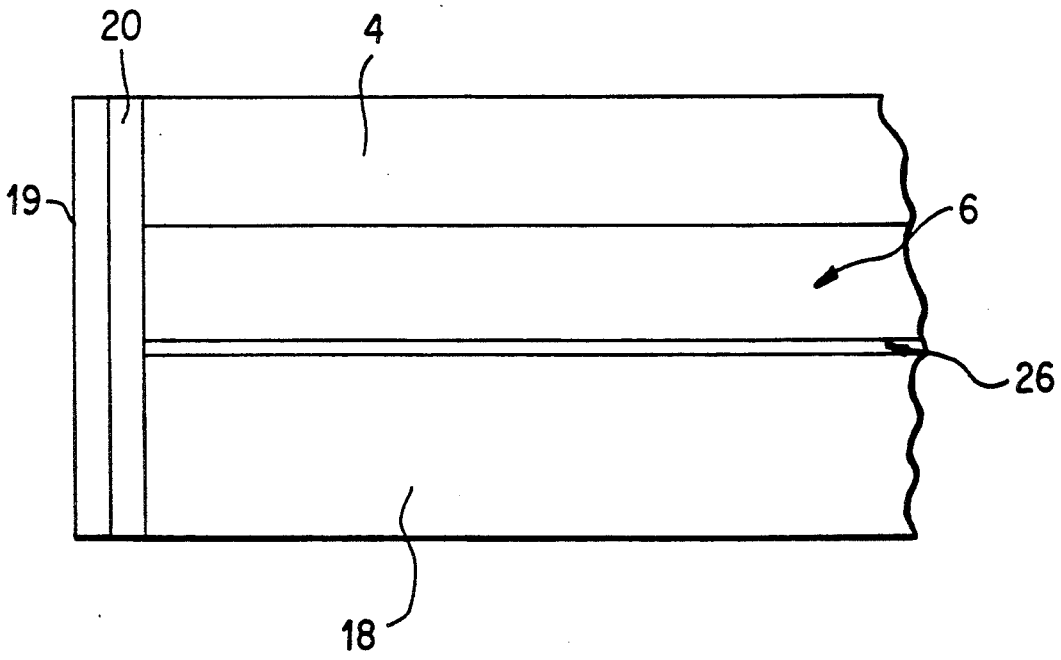

A plurality of printhead subunits 24 are aligned on and bonded to a substrate 28 to form an extended array of printheads to form, for example, a pagewidth printhead. When an ink-repellent coating 19 is formed on the front face of each printhead 24 as shown in FIG. 4, the face will repel ink from the silicon surfaces (channel plate 4 and heater plate 18), but will not repel ink as effectively from polyimide pit layer 26. Thus, spattered ink will tend to collect on the front face in the vicinity of pit layer 26. Since pit layer 26 extends along each of the nozzles, pit layer 26 tends to cause ink which has collected thereon to pool adjacent the nozzles and interfere with the meniscus formation at the nozzles. Thus, some misdirection will persist even after treatment with an ink-repellent material.

The ink which may be used in ink jets of the invention is generally water based containing a glycol additive. Typical glycols are ethylene glycol, diethylene glycol, triethylene glycol, propylene glycol, polyethylene glycol and others. The glycols act as a humectant or hygroscopic agent to prevent the ink in the channels from drying out and blocking the channel. Glycol concentrations between about 5% and about 40% may be used in various ink formulations. Other ink formulations used may contain, for example, glycerol, cyclohexyl pyrollidone, caprolactam, sulfolane, butyl carbitol or 1,2-hexanediol as additives.

The coating material should be insensitive to the ink used while also suppressing the wettability of the ink jet printhead. Ink-repellent coating materials which may be used in the present invention include alkyl siloxanes, alkyl polysiloxanes, halogenated siloxanes, halogenated alkyl siloxanes, and the like, with altyl polysiloxanes preferred. Specific siloxanes include, for example, polydimethylsiloxanes, alkyl chlorosilanes, alkyl methoxysilanes, alkyl ethoxysilanes, fluorinated (completely or partially) alkyl chlorosilanes, methoxysilanes, ethoxysilanes and the like. Commercially available materials include Rain-X ® (polydimethyl siloxane dissolved in ethanol and acidified with a few percent sulfuric acid) from Unelko Corp., Siliclad ® and chlorine terminated polydimethy siloxane telomer available as Glassclad ® from Huls America. Other coatings include those described in U.S. Pat. No. 3,579,540, incorporated herein by reference.

The ink-repellent material of the invention is preferably applied as a solution. A coating may be applied by simply wetting the nozzle-containing front face with a solution containing the ink repellent. The solution may be applied with a swab, such as a Q-tip ®, a trademark of Johnson and Johnson. Other methods of applying the ink-repellent material to the printhead face include spray coating and contact coating by use of brushes, fine bristled brushes, rubber rollers, cotton, cloth or foam rubber (e.g. polyurethane) sponges and applicators, and the like.

Coatings having a thickness from about 50 Angstroms to about 500 Angstroms provide the requisite repellency, with coating thicknesses of about 50 Angstroms to about 200 Angstroms being preferred.

Ink-repellent films formed from an alkyl polysiloxane display excellent adhesion to silicon, are completely transparent and featureless, and are insoluble in glycol-containing inks. The alkyl polysiloxane film renders the printhead face highly ink-repellent. Measurements indicate that the treated surface displays a contact angle for distilled water of between 95° and 100°. This property remains unchanged for at least three months. Fluid build-up is effectively prevented on the face of the array in the vicinity of the nozzles. Further, accumulation of debris on the array face is suppressed. The same is true for films formed from other silanes as well.

In some instances, it is desirable to provide an intermediate coating on the printhead between the ink repellent coating and the front face of the printhead. The intermediate coating allows for the above-described ink-repellent coating to be more uniformly ink-repellent. Intermediate coatings are especially preferred when the front face of the printhead comprises a number of different materials as shown in FIGS. 2 and 4. This intermediate coating 20 provides a base for the ink-repellent coating material to adhere to, and since the entire face is coated with the intermediate coating material, the treated face will be isotropically hydrophobic.

To provide an isotropically hydrophobic surface, the intermediate film may be applied as a thin coating, for example, about 750 Angstroms, over the entire printhead front face. The intermediate film may comprise a material such as silica ($SiO_2$), silicon carbide, glass or other silicon rich materials which are particularly effective for application to silicon and polyimide. By silicon rich, it is meant materials which are rich in silicon (i.e. glass) which can chemically bond to the ink-repellent film. Materials which have hydroxy, silanol or other groups which will chemically react with the ink-repellent to form a bond, are preferred. For example, chlorine groups of Glassclad ® (discussed above) react with hydroxy and silanol groups of glass or other siliceous surfaces to form a chemically bound polydimethylsiloxane "siliconized" surface. A film thickness of about 500 Angstroms to about 5000 Angstroms may be applied, with a thickness of about 500 Angstroms to about 1000 Angstroms being preferred.

The intermediate film may be deposited by electron beam (E-beam) evaporation, sputtering, chemical vapor deposition, plasma deposition and the like. E-beam evaporation allows completed printhead arrays (a portion of which is shown in FIG. 2) to be coated. Sputtering, on the other hand, may be carried out during the wafer phase, i.e., before the bonded wafer sandwich is diced into individual printhead units. Dicing is well known in the art. See for example the above-incorporated U.S. Pat. Nos. 4,774,530 and 4,851,371. During the wafer phase, silica may be sputtered onto the channel plate after the first dicing cut has been completed. The first dicing cut penetrates channel plate 4, pit layer 26 and a portion of heater plate 18 along dashed line 12 but does not completely penetrate heater plate 18. Since the sputtering process is omnidirectional, some of the silica material penetrates into the saw kerf produced by the dicing operations and coats the partially exposed nozzle-containing front faces. After sputtering film has been deposited, the dicing procedure is completed to form the individual printhead subunits. The deposition technique involving sputtering is a preferred method because all of the parts in a complete wafer are coated at once. This is cost effective. Further, sputtered films tend to adhere better than E-beam evaporated films. Chemical vapor deposition (CVD) requires higher temperatures than is desirable when coating printheads containing polyimide and epoxy resins. However CVD can be used to coat other materials or even silicon if necessary.

After the intermediate film 20 has been deposited, the ink-repellent coating is applied. The ink-repellent coating preferably is applied in a manner which prevents the interior channel walls from becoming coated. If ink-repellent material coats the walls of the channels, proper refill of each channel 6 after firing of a droplet is inhibited, which may result in misdirection or drop size variability. The ink-repellent coating is applied to the printhead array face while blowing high velocity filtered gas through the array. The strong gas stream inhibits the ink-repellent material from entering the channels and coating the walls. This technique is highly effective in ensuring that only the front face receives a coating of repellent and not the channel walls. The gas can be air, nitrogen, hydrogen, carbon dioxide or other inert gas.

A fixture may be used wherein a plurality of completed dies are held with the nozzle faces exposed, with a pressurized air or $N_2$ source connected to the fill holes of each die. Gas is blown through the nozzles of each printhead die held by the fixture at the same time that the repellent is applied. This method enables many dies to be treated simultaneously, lowering the repellent treatment cost per die significantly. For an assembled full width ink jet array, the pressurized gas line is connected directly to the ink manifold so gas can be blown through all of the nozzles at the same time while the repellent is applied.

The invention will further be illustrated in the following, non-limiting examples, it being understood that these examples are intended to be illustrative only and that the invention is not intended to be limited to the materials, conditions, process parameters and the like recited herein.

EXAMPLES

Coatings comprising alkyl trichlorosilanes having the formula $CH_3(CH_2)_nSiCl_3$ are applied to ink jets. Coatings are formed from the alkyl trichlorosilanes where n is an integer ranging between 0 and 30. The alkyl trichlorosilane materials are each dissolved in toluene (1% by wt) and applied with a cotton swab to the front faces of ink jet nozzles while blowing air or nitrogen through the jets. After application, the treated printhead is heated at about 100° C. in a moist atmosphere for about 45 minutes. The excess silane is removed with a toluene soaked swab, and the ink jet nozzles are tested.

An alternative cure method may be used which involves immersing the treated part in boiling water for 45 minutes. This method permits removal of HCl formed as a by product of the reaction with the $SiO_2$ surface on the nozzle containing face.

Nozzles treated with n-triacontyltrichlorosilane ($C_{30}H_{61}Cl_3Si$) is preferred because it provides the most durable, abrasion resistant film in the alkyl series tested.

Methoxy and ethoxy versions of the above alkyl trichlorosilane coatings are tested. Three coatings comprising n-octadecyltriethoxysilane ($C_{24}H_{52}O_3Si$), n-hexadecyltriethoxysilane ($C_{22}H_{48}O_3Si$) and n-octadecyltrimethoxysilane ($C_{21}H_{46}O_3Si$), respectively, are hydrolyzed and reacted with an $SiO_2$ surface of an ink jet nozzle. The coatings are cured at 100°-120° C. in a moist atmosphere to chemically bond them to the $SiO_2$ surface, and to promote cross-linking. Contact angles for these films for $H_2O$ range between 90°-95°.

Fluorinated versions (alkyl and fluorinated alkyl silanes) of the above silanes are also tested. Coatings formed from 1H,1H,2H,2H-perfluorodecyltrichlorosilane ($F(CF_2)_8\ CH_2CH_2SiCl_3$) or 1H,1H,2H,2H-perfluorodecyltriethoxysilane ($(F(CF_2)_8CH_2CH_2Si(OCH_2CH_3)_3)$) dissolved in perfluoroheptane (1% by weight) produce effective repellent films. The material is applied onto a printhead face with a cotton swab while blowing air through the channels. Curing is initiated by heating as described above. Excess material is rinsed off after curing with a perfluoroheptane soaked cotton swab. The contact angle ($H_2O$) for these films range between 100° and 105°.

While the invention has been described with reference to particular preferred embodiments, the invention is not limited to the specific examples given. For example, the present invention finds use in any type of ink jet printhead, and in particular to printheads having nozzle-containing faces made from different materials. The present invention can be used in printheads in which droplet formation can be controlled by a variety of means other than resistive elements, such as, for example, piezoelectric transducers. Other embodiments and modifications can be made by those skilled in the art without departing from the spirit and scope of the invention.

What is claimed is:

1. An ink jet printhead, comprising:

an upper substrate defining a channel plate including one side, said channel plate comprised of a silicon wafer;

a lower substrate defining a heater plate including one side, said heater plate comprised of a silicon wafer;

an insulative layer between the upper and lower substrates, said insulative layer including one side and being comprised of polyimide, the one sides of the upper substrate, lower substrate and insulative layer defining a front face;

an ink-repellent layer comprising an alkyl polysiloxane over said front face; and an intermediate coating between the ink-repellent layer and the front face, said intermediate coating comprising a silicon rich material which is capable of chemically bonding with the ink repellant.

2. The printhead of claim 1, wherein said ink-repellent layer comprises a material selected from the group consisting of polydimethylsiloxanes.

3. The printhead of claim 1, wherein said intermediate layer is comprised of a material selected from the group consisting of silica, silicon carbide, and glass.

4. The printhead of claim 1, wherein said intermediate layer is deposited by one of electron beam evaporation, sputtering, and chemical vapor deposition.

5. The printhead of claim 1, wherein said intermediate layer has a thickness of about 500 Angstroms to about 1000 Angstroms.

6. (Twice Amended) An ink jet printhead comprising: a front face containing nozzles and areas made from differing materials;

an ink-repellant layer over said front face, said ink repellent layer comprising alkyl polysiloxane; and an intermediate layer between said ink-repellent layer and said front face, said intermediate layer being comprised of a silicon rich material which is capable of chemically bonding with the ink repellent.

7. The printhead of claim 6, wherein said intermediate layer is comprised of a material selected form the group consisting of silica, silicon carbide and glass.

8. The printhead of claim 6, wherein said nozzle-containing front face is formed form at least silicon.

9. An ink jet printhead, comprising:

a front face having nozzles and areas made from differing materials;

an ink-repellant layer comprising alkyl polysiloxanes over said front face; and an intermediate layer between said ink-repellent layer and said front face whereby said ink-repellent layer is isotropically hydrophobic, said intermediate layer comprised of a silicon rich material capable of chemically bonding with the ink-repellent.

10. The printhead of claim 9, wherein said intermediate layer is comprised of a mater a selected from the group consisting of silica, silicon carbide and glass.

11. The printhead of claim 9, wherein said ink-repellent layer comprises polydimethylsiloxane.

12. The printhead of claim 9, wherein one of said differing materials is silicon.

13. The printhead of claim 12, wherein another of said differing materials is polyimide.

* * * * *